United States Patent [19]

Westveer et al.

[11] Patent Number: 4,655,689

[45] Date of Patent: Apr. 7, 1987

[54] ELECTRONIC CONTROL SYSTEM FOR A VARIABLE DISPLACEMENT PUMP

[75] Inventors: Robert C. Westveer, Kalamazoo; John K. Vandervoort, Richland, both of Mich.

[73] Assignee: General Signal Corporation, Stamford, Conn.

[21] Appl. No.: 778,208

[22] Filed: Sep. 20, 1985

[51] Int. Cl.[4] ..... F04B 1/26; F16D 31/02

[52] U.S. Cl. ..... 417/53; 417/222; 60/390; 60/449; 60/911

[58] Field of Search ..... 417/213, 216–218, 417/221, 222, 53, 24, 42; 60/449, 390, 911; 73/168

[56] References Cited

U.S. PATENT DOCUMENTS

| | | | |
|---|---|---|---|
| 3,231,807 | 1/1966 | Willis | 318/313 |
| 3,646,754 | 3/1972 | Koch et al. | 60/390 |
| 3,667,225 | 6/1972 | Karman | 60/390 |
| 3,788,775 | 1/1974 | Leutner et al. | 417/222 |
| 4,143,309 | 3/1979 | Patterson | 318/807 |
| 4,158,290 | 6/1979 | Cornell | 60/911 X |
| 4,191,270 | 3/1980 | Monteith | 60/449 X |
| 4,274,257 | 6/1981 | Koch, Jr. et al. | 417/222 |
| 4,285,639 | 8/1981 | Woodring et al. | 417/218 |
| 4,316,129 | 2/1982 | Shapiro et al. | 318/313 |
| 4,351,152 | 9/1982 | Reynolds et al. | 60/449 X |
| 4,393,966 | 7/1983 | Kono et al. | 417/42 X |
| 4,395,199 | 7/1983 | Izumi et al. | 60/449 X |
| 4,432,703 | 2/1984 | Beutler et al. | 417/218 X |
| 4,455,770 | 6/1984 | Presley | 60/449 X |
| 4,494,911 | 1/1985 | Davis | 417/222 |
| 4,496,289 | 1/1985 | Heiser | 417/222 X |
| 4,510,750 | 4/1985 | Izumi et al. | 417/222 X |
| 4,534,707 | 8/1985 | Mitchell | 417/222 X |

FOREIGN PATENT DOCUMENTS

| | | | |
|---|---|---|---|
| 104381 | 6/1983 | Japan | 417/218 |
| 2151705 | 7/1985 | United Kingdom | 417/220 |

*Primary Examiner*—Carlton R. Croyle
*Assistant Examiner*—Paul F. Neils
*Attorney, Agent, or Firm*—Barnes & Thornburg

[57] ABSTRACT

An electronic control system for a variable displacement pump comprises apparatus for sensing the actual position of the displacement determinative element and the actual rotational speed of the pump cylinder block, and for producing representative signals which are combined to produce a signal indicative of actual output flow rate. The displacement determinative elements position and the cylinder rotational speed are sensed directly by sensors mounted within the housing of the pump. The speed sensor is disposed in close proximity to, and aligned with marks inscribed on, the outer surface of the rotatable cylinder block. The volumetric efficiency of the pump is also sensed by and used to determine the actual flow rate.

19 Claims, 3 Drawing Figures

ELECTRONIC CONTROL SYSTEM FOR A VARIABLE DISPLACEMENT PUMP

BACKGROUND AND SUMMARY OF THE INVENTION

The present invention relates generally to pump control systems and, more particularly, to closed loop pump output control systems for variable displacement piston pumps.

The present invention is an improvement on the invention described in U.S. Pat. No. 4,494,911 to Davis entitled "Piston Pump Servo Control." The disclosure in U.S. Pat. No. 4,494,911, including all written descriptions and illustrations, is hereby incorporated by reference into the present disclosure. To avoid possible confusion, like reference numerals are used whenever possible.

As noted in the above-mentioned patent specification, variable displacement axial piston pumps typically have swash plates which may be adjusted so as to control the pump output flow. These swash plates are usually mounted to be rotatable about an axis and the angular position of the swash plate is proportional to the pump output level. To provide precise control of the pump output, the angle of the swash plate can be measured to produce feedback signals which may be compared to signals representing the desired pump output. A difference or "error" between these signals is used to produce a control signal for adjusting the swash plate position and, thus, the pump output. It should be noted that this system does not take into account speed variations in the prime mover speed.

As hydraulic systems continue to develop and become more sophisticated, the need for more elaborate and precise controls increases. Electronic and electrohydraulic controls for pumps permit the use of microprocessors and similar signal processing means for hydraulic system control. One of the problems associated with these electronic systems is the availability of dependable, cost efficient transducers, especially flow transducers. Turbine-type flow meters are available, but are costly and have a limited range of effectiveness. Measuring the pressure drop across a fixed orifice is also relatively costly and inefficient.

A known system for controlling the output rate of a variable displacement pump is described in U.S. Pat. No. 4,395,199 to Izumi et al. In the Izumi patent, a plurality of variable displacement hydraulic pumps are powered by an internal combustion engine. An engine speed deviation is obtained by calculating a difference between a target engine speed set by the operator and the actual output speed of the engine. The engine speed deviation is converted by processing circuitry into a pump control coefficient which is functionally related to the deviation. This coefficient is multipled with an output variable ($L_1$ or $L_2$) which varies with external manipulation of the operation levers of the pumps. The resulting product is summed with a signal which represents the inclination angle of the pump swash plate, and the resulting sum is used to control that angle. This system is relatively complex and is dependant upon the accuracy with which the engine speed can be measured and the degree to which engine speed is actually representative of the true pump speed, as illustrated by Izumi in FIG. 5. Steps also must be taken to prevent short term variations in speed of the internal combustion engine from interferring with operation of the control loop.

Accordingly, there exists a need to provide a simple and dependable electronic control system for variable displacement pumps which has increased precision and stability and which can be implemented in a cost efficient manner. An object of the present invention is to provide such a system.

Another object of the present invention is to provide an electronic control system for variable displacement pumps which utilizes a direct measurement of pump cylinder block speed to calculate an error signal which is used to control the position of the displacement determinitive element.

A still further object of the present invention is to provide an electronic control system for variable displacement pumps which include compensation for volumetric efficiency.

Yet another object of the present invention is to provide an electronic control system for variable displacement pumps wherein the pump cylinder speed sensor is mounted within the pump housing.

These and other objects are attained in an electronic control system for variable displacement pumps which includes means for measuring the actual position of the displacement determinitive element and the actual rotational speed of the pump cylinder block, and for producing a signal which is representative of the actual output flow rate of the pump. This signal is compared with a signal which is representative of the desired flow rate and an error signal is produced to control the position of the displacement determinative element. The signal representatives of actual output flow rate may be compensated for decreasing volumetric efficiency. The means for producing a signal indicated of the actual position of the displacement determinative element is preferably a rotary potentiometer mounted within the pump housing and directly connected to the swash plate. The rotary potentiometer is mounted in the pump housing such that its rotational axis is along a rotational axis of the positionable swash plate.

The means for producing a signal indicative of the actual rotational speed of the pump cylinder block is preferably an optical sensor mounted in the pump housing adjacent to the rotatable cylinder block. The optical sensing device produces a frequency signal by sensing the passage of marks inscribed on the outer surface of the cylinder block. This signal is preferably buffered and converted to an analog voltage signal which is combined by an analog multiplier with an analog signal produced by the rotary potentiometer. The resulting product represents a direct measure of the actual output flow rate of the pump. The means for compensating for decreasing volumetric efficiency includes a pressure sensor at the pump outlet to measure the load pressure. The pressure signal is added to the desired rate signal. In an especially preferred embodiment of the invention, the means for comparing the desired and actual flow rate signals includes a failsafe circuit for forcing the displacement determinative element to zero stroke position when any of the sensor(s) fail.

The present invention provides a method for measuring the output rate of a variable displacement pump. The pump has a housing, a rotatable cylinder block within the housing having a plurality of pistons reciprocating in the housing, and a positional displacement determinative element. The method includes the steps of producing a signal which indicates the actual position of the displacement determinative element, and producing a signal indicative of the actual rotational speed of the rotatable cylinder block. These signals are combined to produce a signal indicative of the actual output flow rate.

Other objects, advantages and novel features of the present invention will become readily apparent when the following detailed description of the preferred embodiment is considered in conjunction with the attached drawings.

DETAILED DESCRIPTION OF THE DRAWINGS

Figure 1:
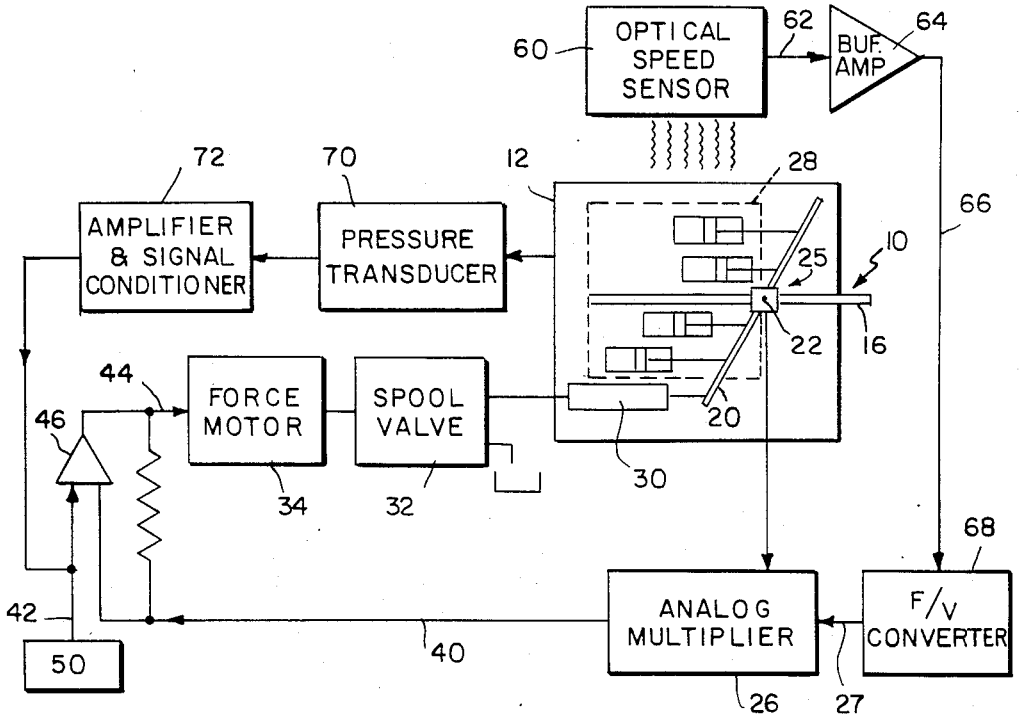
FIG. 1 shows a schematic block diagram of a pump control system according to a preferred embodiment of the present invention.

FIG. 1, which is a schematic block diagram of a closed loop pump servo control system according to the present invention, shows a variable displacement piston pump 10 having a displacement determinitive element illustrated as a swash plate 20 within a pump housing 12. The angular position of swash plate 20 about axis of rotation 22, shown in FIG. 1 as a pivot point extending normally out of the plane of the drawing, may be altered by trunion control 30 which is responsive to spool valve 32. Spool valve 32 is, in turn, actuated by force motor 34 in response to electric control signals applied thereto. Spool valves and force motors per se are known in the art (see, for example, U.S. Pat. No. 4,351,152). Although FIGS. 1 and 2 illustrate the system for a variable displacement axial pump wherein the displacement determinitive element is a swash plate, the system is also applicable to variable displacement radial pumps wherein the displacement determinitive element is a piston which controls the eccentricity of the axes of a cam ring relative to the axis of the cylinder block.

Rotary potentiometer 25 is mounted on pump housing 12 and is directly connected to swash plate 20. Axis of rotation 22 is common to both potentiometer 25 and swash plate 20. Potentiometer 25 provides a d.c. signal indicative of the angular position of the swash plate to analog multiplier 26. The output of analog multiplier 26 is connected, via line 40, to an input of comparator means 46. Input control means 50 provides a d.c. signal indicative of the desired output flow rate to a second input of comparator means 46, via line 42. Comparator means 46 compares the signals incoming from lines 40 and 42 and produces output signals along line 44 as electrical control signals for force motor 34.

Analog multiplier 26 has a second input which receives, via line 27, a signal indicative of the rotational speed of a rotatably mounted cylinder block 28 within the pump housing. In the preferred embodiment illustrated, the speed of cylinder block 28 is sensed by optical speed sensor 60 which is described in more detail below. Speed sensor 60 provides a frequency signal, via line 62, to a buffer amplifer 64. The buffered and amplified frequency signal is provided, via line 66, to the input of frequency to voltage converter 68. Converter 68 provides an analog voltage signal to analog multiplier 26, via line 27.

Figure 2:
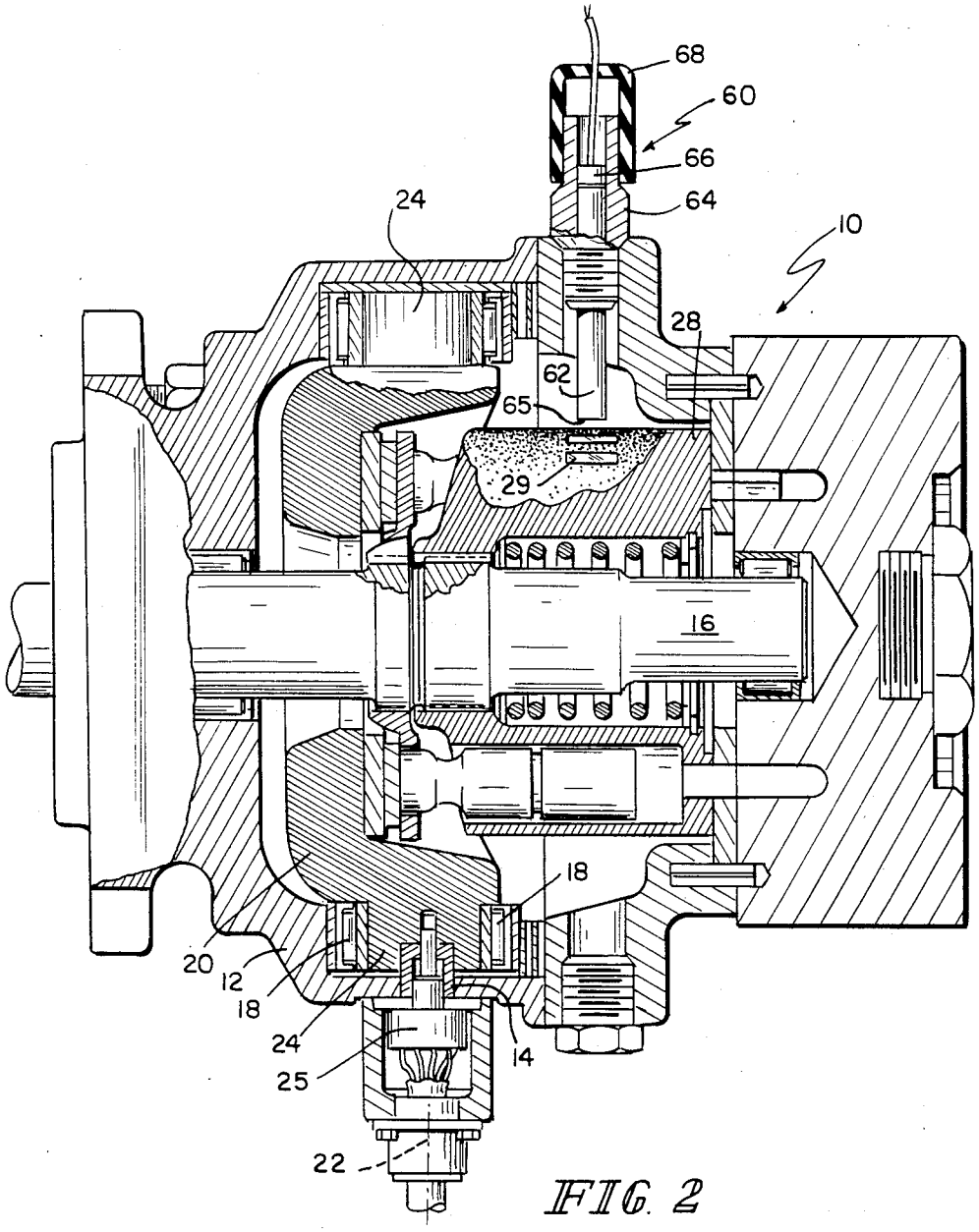
FIG. 2 shows a cross-section of a variable displacement pump incorporating an optical speed sensor according to the present invention.

As shown in FIG. 2, potentiometer 25 is mounted directly on housing 12 of pump 10 and is disposed about rotational axis 22. Swash plate 20 has axial trunions 24 supported on bearings 18 within housing 12, which permits swash plate 20 to pivot about axis 22 within housing 12. As drive shaft 16 rotates within pump 10, the angular position of swash plate 20, with respect to axis 22, remains constant unless altered by trunion control 30.

Optical speed sensor 60 includes a translucent rod 62 which is mounted in pump housing 12 by threaded fitting 64. The inner most end 65 of rod 62 is positioned directly adjacent to the surface of pump cylinder block 28. Rod 62 is aligned with marks 29 on the outer surface of cylinder block 28. The clearance between the end of rod 62 and the surface of cylinder block 28 is kept to a minimum in order to minimize the interference in light transmission caused by, for example, air bubbles in the hydraulic fluid. Also mounted within fitting 64 is optical transducer 66 which is connected by wires to the remaining components of the optical speed sensing system. A cover 68 is provided to protect the optical transducer from contamination.

Translucent rod 62 is preferebly a Lucite rod and is sealed in fitting 64 by a layer of RTV silicon rubber. The optical transducer is a known device and is similar to Texas Instrument's TI-149 and is powered by a 12 volt d.c. power supply.

As a preferred alternative, the optical speed sensor 60 would include a high temperature optical transducer 66, for example General Instruments MSA7 reflective object sensor, mounted adjacent the marks 29 without a translucent rod 62. If the optical transducer is made for high temperature environments, it can be placed in the housing.

To further increase the accuracy of the control system, the volumetric efficiency or "slip" of the pump is measured. The volumetric efficiency decreases with increased pump load. A pressure transducer 70 measures the load pressure at the pump outlet. The electrical pressure signal is amplified and conditioned by circuit 72 to provide a proportioned signal to the command signal input 42 to comparator 46, so that the error signal and consequently the pump displacement increases as load pressure increases to compensate for reduced volumetric efficiency and maintain the outlet flow constant.

One method of providing the marks 29 on the cylinder block is by providing a mask and applying a suitable paint. Preferably, the marks 29 are formed by milling off the thin layer of black oxide coating that covers the entire cylinder block. The black oxide layer is used to harden specific surfaces of the cylinder block and is not needed on the exterior. By forming openings in the black oxide to expose the shiny metal of the cylinder block, a high contrast optical mark is formed.

This arrangement for measuring actual pump speed is advantageous due to the fact that the speed measurement is taken directly at the rotatable pump cylinder. Thus, error due to irregularities in the speed of the prime mover and inaccurate conversion and/or processing of indirect speed measurements, along with other similar problems are avoided. Additionally, the preferred arrangement of the present invention is simpler, more reliable, and more cost efficient than the more complex systems of the type discussed above.

Figure 3:
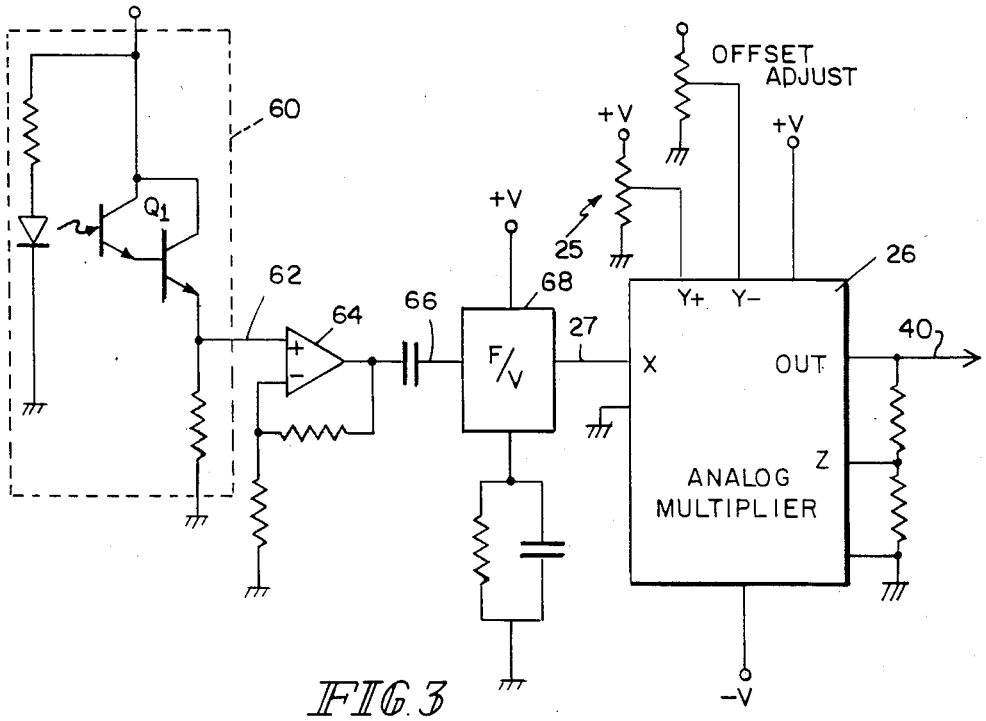
FIG. 3 shows a schematic diagram of a circuit suitable for use in the present invention.

FIG. 3 of U.S. Pat. No. 4,494,911 shows a schematic diagram of a six amplifier circuit which does not include the optical speed sensing circuitry and the analog multiplier of the present invention. FIG. 3 of the present disclosure shows a schematic diagram of these components. It is to be understood that the diagram of FIG. 3 can be integrated into the diagram of FIG. 3 of U.S. Pat. No. 4,494,911 to produce a complete schematic for practicing the present invention. The detailed discussion of the latter mentioned FIG. 3 is hereby incorporated into this discussion by reference thereto and will not be repeated here.

FIG. 3 of the present disclosure shows optical sensor 60 which has an output connected to the positive input of amplifier 64, via line 62. The output of amplifier 62 is connected, via line 66, to the input of a frequency-to-voltage converter 68. The output of converter 68 is connected; via line 27, to an input of analog multiplier 26. Analog multiplier 26 also receives a signal from swash plate position potentiometer 25. As noted above, the output of analog multiplier 26 is connected, via line 40 to comparator means 46.

As noted above, the detailed structure and operation of the remaining components shown in FIG. 1, as well as a failsafe reference circuit, is described in detail in U.S. Pat. No. 4,494,911.

Although the present invention has been described and illustrated above in detail, this description is to be taken by way of illustration and example only and not by way of limitation. Those skilled in the art will recognize that many variations on this example are within the scope of the subject invention. The spirit and scope of the subject invention are to be limited only by the terms of the appended claims.

What is claimed is:

1. An electronic control system for a variable displacement pump having a housing, a rotatable cylinder block within said housing having a plurality of pistons reciprocating therein, and a positional displacement determinative element for controlling the output flow rate of the pump, said control system comprising:

means for altering the position of said displacement determinative element so as to change the output flow rate of the pump in response to control signals;

means for producing a signal representative of a desired output flow rate;

means for producing a signal indicative of the actual position of said displacement determinative element;

means for producing a signal indicative of the actual rotational speed of said rotatable cylinder block;

means for combining said signals indicative of the actual position of the displacement determinative element and the actual rotational speed of the cylinder block and for producing a signal representative of the actual output flow rate; and means for comparing the signals representative of the desired and actual flow rates and for producing an error signal representative of a difference between said rates and for applying said error signal to said means for altering the position of said displacement determinative element so as to change the actual flow rate and cause said error signal to be decreased.

2. An electronic control system according to claim 1, wherein said signals indicative of the actual position of said displacement determinative element and the actual rotational speed of the cylinder block are analog signals, and wherein said means for combining said signals includes an analog multiplier.

3. An electronic control system according to claim 1, wherein said displacement determinative element is a swash plate and said means for producing a signal indicative of the actual position of the swash plate is mounted within the pump housing and is directly connected to said swash plate.

4. An electronic control system according to claim 3, wherein said means for producing a signal indicative of the actual position of the swash plate includes a rotary potentiometer.

5. An electronic control system according to claim 1, including means for producing a signal indicative of the volumetric efficiency of said pump and said comparing means increases said error signal for decreased volumetric efficiency.

6. An electronic control system according to claim 5, wherein said means for producing a signal indicative of volumetric efficiency includes a means for sensing the load pressure at the pumps outlet and said comparing means increases said error signal proportional to said sensed load pressure.

7. An electronic control system according to claim 1, wherein said means for producing a signal indicative of the actual rotational speed of said rotatable cylinder block is mounted in said pump housing.

8. An electronic control system according to claim 7, wherein said means mounted in said pump housing includes optically distinguishable indicia and optical speed sensing means for sensing said optically distinguishable indicia.

9. An electronic control system according to claim 8, wherein said cylinder block has a non-reflective coating, and wherein said optically distinguishable indicia are spaced openings exposing a reflective surface of said cylinder block.

10. An electronic control system according to claim 8, wherein said optical speed sensing means includes a translucent rod mounted in said pump housing adjacent to said rotatable cylinder block and an optical sensing device disposed adjacent to an outermost end of said translucent rod.

11. An electronic control system according to claim 10, wherein an innermost end of said translucent rod is disposed in close proximity to an outer surface of said cylinder block and is aligned with at least one mark on said outer surface.

12. An electronic control system according to claim 11, wherein said means for producing a signal indicative of the actual cylinder block speed includes means for converting frequency signals to an analog voltage signal.

13. A method for measuring and using with a device the output rate of a variable displacement pump having a housing, a rotatable cylinder block within said housing having a plurality of pistons reciprocating therein, and a positional displacement determinative element, comprising the steps of:

a. producing a signal indicative of the actual position of said displacement determinative element;

b. producing a signal indicative of the actual rotational speed of the rotatable cylinder block;

c. combining said signals produced in steps a and b to produce the signal indicative of the actual output flow rate; and d. providing said signal indicative of the actual output flow rate to said device;

wherein step b includes sensing the passage of marks inscribed on an outer surface of the rotatable cylinder.

14. A method according to claim 13, wherein said marks are sensed by optical sensing means mounted in the housing of the pump.

15. A method for measuring and using with a device the output rate of a variable displacement pump having a housing, a rotatable cylinder block within said housing having a plurality of pistons reciprocating therein, and a positional displacement determinative element, comprising the steps of:

a. producing a signal indicative of the actual position of said displacement determinative element;

b. producing a signal indicative of the actual rotational speed of the rotatable cylinder block;

c. combining said signals produced in steps a and b to produce the signal indicative of the actual output flow rate; and d. providing said signal indicative of the actual output flow rate to said device, including step e producing a signal indicative of volumetric efficiency which modifies the signal produced in step c.

16. A method for controlling the output rate of a variable displacement pump having a housing, a rotatable cylinder block within said housing having a plurality of pistons reciprocating therein, and a positional displacement determinative element, comprising the steps of:

a. producing a signal representative of a desired output flow rate;

b. producing a signal indicative of the actual position of said displacement determinative element;

c. producing a signal indicative of the actual rotational speed of the rotatable cylinder block;

d. combining said signals produced in steps b and c to produce a signal indicative of the actual output flow rate;

e. comparing the signals produced in steps a and d and producing an error signal representative of a difference between said signals: and f. altering the position of the displacement determinative element so as to decrease the magnitude of the error signal produced in step e.

17. A method according to claim 16, including producing a signal indicative of the volumetric efficiency of the pump and varying the error signal as a function of said signal indicative of volumetric efficiency.

18. A method according to claim 16, wherein step c includes sensing the passage of marks inscribed on an outer surface of the rotatable cylinder block.

19. A method according to claim 18, wherein said marks are sensed by optical sensing means mounted in the housing of the pump.

* * * * *